US010679571B2

(12) United States Patent
Chiu et al.

(10) Patent No.: US 10,679,571 B2
(45) Date of Patent: Jun. 9, 2020

(54) ELECTRONIC PAPER DISPLAY AND METHOD FOR DRIVING ELECTRONIC PAPER DISPLAY PANEL

(71) Applicant: E Ink Holdings Inc., Hsinchu (TW)

(72) Inventors: Chen-Kai Chiu, Hsinchu (TW); Hsin-I Wu, Hsinchu (TW); Feng-Shou Lin, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 119 days.

(21) Appl. No.: 15/893,685

(22) Filed: Feb. 11, 2018

(65) Prior Publication Data

US 2018/0240412 A1 Aug. 23, 2018

(30) Foreign Application Priority Data

Feb. 20, 2017 (CN) ..... 2017 1 0090713

(51) Int. Cl.
*G09G 3/34* (2006.01)
*G09G 3/20* (2006.01)

(52) U.S. Cl.
CPC ..... *G09G 3/344* (2013.01); *G09G 3/2003* (2013.01); *G09G 2310/065* (2013.01); *G09G 2310/08* (2013.01); *G09G 2320/041* (2013.01); *G09G 2320/0666* (2013.01)

(58) Field of Classification Search
CPC ..... G09G 3/344; G09G 3/2003; G09G 2310/065; G09G 2310/08; G09G 2320/041; G09G 2320/0666
See application file for complete search history.

(56) References Cited

U.S. PATENT DOCUMENTS

| | | | | |
|---|---|---|---|---|
| 5,648,793 | A | 7/1997 | Chen | |
| 7,215,460 | B2 | 5/2007 | Ishii | |
| 7,710,377 | B2 | 5/2010 | Kang et al. | |
| 8,054,288 | B2 | 11/2011 | Sugita et al. | |
| 8,279,157 | B2 | 10/2012 | Uehara et al. | |
| 2004/0227720 | A1* | 11/2004 | Shikina | G09G 3/344 345/107 |
| 2006/0209011 | A1* | 9/2006 | Miyasaka | G09G 3/344 345/107 |
| 2006/0291122 | A1 | 12/2006 | Zhou et al. | |

(Continued)

FOREIGN PATENT DOCUMENTS

| | | |
|---|---|---|
| CN | 1689066 | 10/2005 |
| CN | 1816841 | 8/2006 |
| WO | 2005004101 | 1/2005 |

OTHER PUBLICATIONS

"Office Action of China Counterpart Application," dated Aug. 22, 2019, p. 1-p. 8.

*Primary Examiner* — Ricardo Osorio
(74) *Attorney, Agent, or Firm* — JCIPRNET

(57) ABSTRACT

An electronic paper display including an electronic paper display panel and a driver circuit is provided. The electronic paper display panel includes a plurality of pixels. The driver circuit is coupled to the electronic paper display panel. The driver circuit drives a target pixel of the pixels to display a color by using a driving signal. The driving signal includes a reset period, an interleaving period, and a display period. A voltage of the driving signal is zero during the interleaving period. In addition, a method for driving an electronic paper display panel is also provided.

8 Claims, 3 Drawing Sheets

(56) References Cited

U.S. PATENT DOCUMENTS

| | | | | |
|---|---|---|---|---|
| 2008/0297457 | A1 | 12/2008 | Song et al. | |
| 2009/0096722 | A1 | 4/2009 | Moriya et al. | |
| 2009/0225107 | A1* | 9/2009 | Nose | G09G 3/3611 345/697 |
| 2010/0156967 | A1 | 6/2010 | Watanuki et al. | |
| 2011/0128267 | A1 | 6/2011 | Hsu | |
| 2011/0291708 | A1* | 12/2011 | Ozawa | G09G 3/344 327/108 |
| 2012/0169696 | A1* | 7/2012 | Kim | G09G 3/344 345/211 |
| 2013/0135282 | A1* | 5/2013 | Jeon | G09G 3/3696 345/212 |
| 2015/0239239 | A1* | 8/2015 | Otokita | B41J 2/04541 347/10 |
| 2015/0294644 | A1* | 10/2015 | Matsushima | G01C 21/365 345/589 |
| 2016/0034070 | A1* | 2/2016 | Hayashi | G06F 3/044 345/174 |
| 2016/0349907 | A1* | 12/2016 | Kobayashi | G09G 3/3655 |
| 2018/0190202 | A1* | 7/2018 | Kong | G09G 3/3644 |

* cited by examiner

ELECTRONIC PAPER DISPLAY AND METHOD FOR DRIVING ELECTRONIC PAPER DISPLAY PANEL

CROSS-REFERENCE TO RELATED APPLICATION

This application claims the priority benefit of China application serial no. 201710090713.5, filed on Feb. 20, 2017. The entirety of the above-mentioned patent application is hereby incorporated by reference herein and made a part of this specification.

BACKGROUND OF THE INVENTION

Field of the Invention

The invention relates to a display and a method for driving a display panel, and particularly relates to an electronic paper display and a method for driving an electronic paper display panel.

Description of Related Art

Since electronic paper display panel has advantages of light weight, durability and low power consumption that meets energy saving and environmental protection, it has been widely applied to electronic readers (for example, electronic books, electronic news papers) or other electronic devices (for example, electronic tags) in the market. In the existing technique, when a driver circuit of the electronic paper display drives an electronic paper display panel, the driver circuit generally drives the electronic paper display panel to first display a black color, white color and a gray level portion, and then drives the electronic paper display panel to display a color portion. However, the driving method of the existing technique is liable to have a color distortion phenomenon when driving the electronic paper display panel to display the color portion.

SUMMARY OF THE INVENTION

The invention is directed to an electronic paper display and a method for driving an electronic paper display panel, where colors displayed by pixels are not distorted.

The invention provides an electronic paper display including an electronic paper display panel and a driver circuit. The electronic paper display panel includes a plurality of pixels. The driver circuit is coupled to the electronic paper display panel. The driver circuit drives at least one target pixel of the pixels to display a color by using a driving signal. The driving signal includes a reset period, an interleaving period, and a display period, and a voltage level of the driving signal is zero during the interleaving period.

In an embodiment of the invention, a timing sequence for the driving signal driving the at least one target pixel is sequentially the reset period, the interleaving period and the display period.

In an embodiment of the invention, the driver circuit first drives the at least one target pixel to display a black color or a white color during the reset period by using the driving signal, and then drives the at least one target pixel to display the color during the display period.

In an embodiment of the invention, the electronic paper display further includes a temperature sensor. The temperature sensor is coupled to the driver circuit. The temperature sensor is configured to sense a temperature of the electronic paper display, and transfers a temperature signal to the driver circuit.

In an embodiment of the invention, the driver circuit adjusts a time length of the interleaving period according to the temperature signal and a look-up table.

The invention provides a method for driving an electronic paper display panel, which includes following steps. At least one target pixel in a plurality of pixels on the electronic paper display panel is driven to display a color by using a driving signal. The driving signal includes a reset period, an interleaving period, and a display period. A voltage level of the driving signal is zero during the interleaving period.

In an embodiment of the invention, a timing sequence for the driving signal driving the at least one target pixel is sequentially the reset period, the interleaving period and the display period.

In an embodiment of the invention, the step of driving the at least one target pixel in the pixels on the electronic paper display panel to display the color by using the driving signal includes: first driving the at least one target pixel to display a black color or a white color during the reset period by using the driving signal, and then driving the at least one target pixel to display the color during the display period by using the driving signal.

In an embodiment of the invention, the method for driving an electronic paper display panel further includes sensing a temperature of the electronic paper display, and transferring a temperature signal to the driver circuit.

In an embodiment of the invention, the method for driving an electronic paper display panel further includes adjusting a time length of the interleaving period according to the temperature signal and a look-up table.

According to the above description, in an embodiment of the invention, the voltage level of the driving signal is zero during the interleaving period. By using the driving signal to drive the pixel to display color, distortion of the color is avoided.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
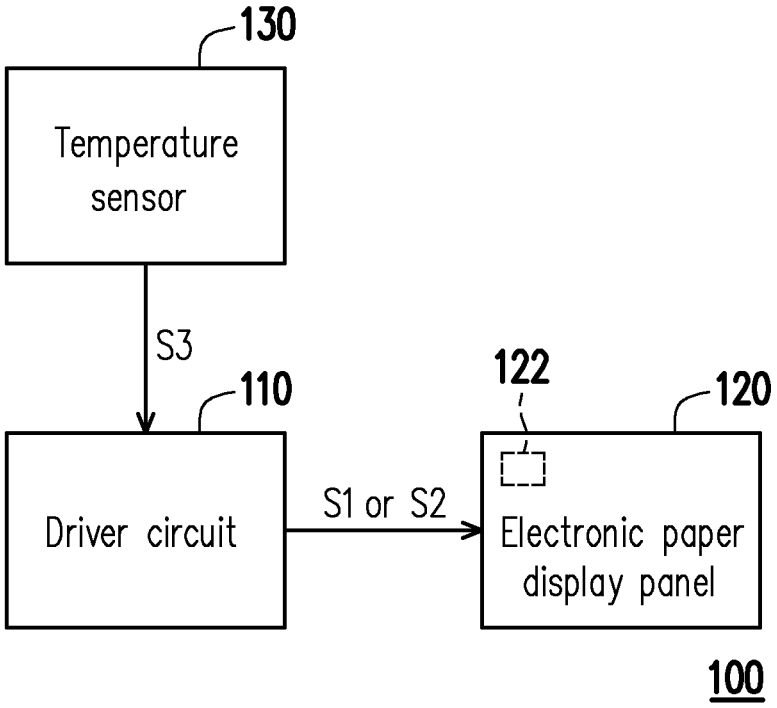
FIG. 1 is a schematic diagram of an electronic paper display according to an embodiment of the invention.
Figure 2:
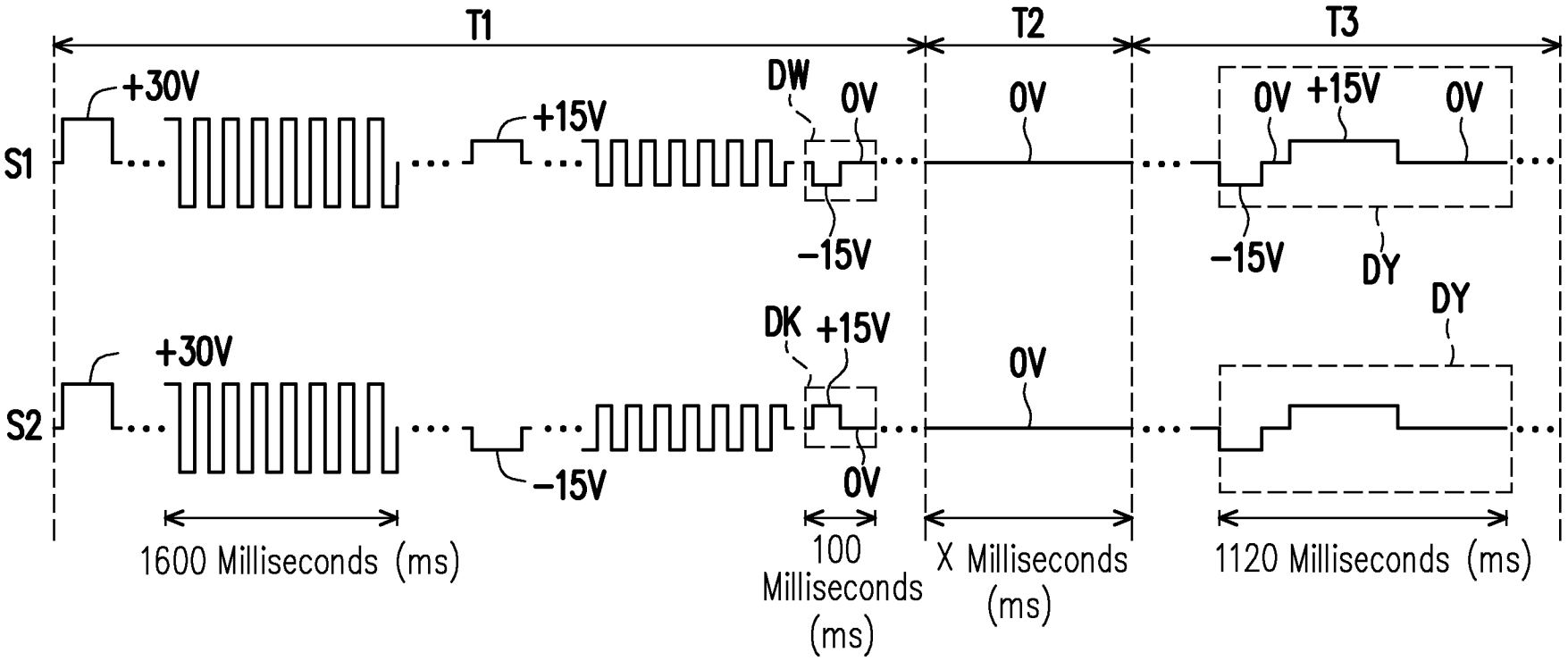
FIG. 2 is a waveform schematic diagram of a driving signal according to the embodiment of FIG. 1.

FIG. 1 is a schematic diagram of an electronic paper display according to an embodiment of the invention. FIG. 2 is a waveform schematic diagram of a driving signal according to the embodiment of FIG. 1. Referring to FIG. 1 and FIG. 2, the electronic paper display 100 of the present embodiment includes a driver circuit 110, an electronic paper display panel 120 and a temperature sensor 130. The driver circuit 110 is coupled to the electronic paper display panel 120. The temperature sensor 130 is coupled to the driver circuit 110. In the present embodiment, the electronic paper display panel 120 includes a plurality of pixels (not shown) for displaying a color image frame, for example, including a black color portion, a white color portion and a color portion. The driver circuit 110 drives a target pixel 122 in the electronic paper display panel 120 to display a color (which is, for example, a yellow color, though the invention is not limited thereto, and other color can also be displayed) by using a driving signal S1 or S2 shown in FIG. 2. In the present embodiment, the driving signal 110, for example, includes a timing controller used for driving the electronic paper display panel 120 or an electronic circuit used for generating the driving signal according to the timing controller.

In the present embodiment, the driving signal S1 or S2 includes a reset period T1, an interleaving period T2, and a display period T3. A timing sequence for the driving signal S1 or S2 driving the target pixel 122 is sequentially the reset period T1, the interleaving period T2 and the display period T3. A voltage level of the driving signal S1 or S2 is zero (i.e. 0 volt (V)) during the interleaving period T2. Since a thin-film transistor type electrophoretic display is easy to have a problem of image display chromatic aberration in low temperature, the driver circuit 110 first drives the target pixel 122 to display a black color or a white color during the reset period T1, and then drives the target pixel 122 to display the corresponding color, for example, the yellow color during the display period T3 according to an image frame to be displayed. In the present embodiment, between the reset period T1 and the display period T3, the timing sequence for the driving signal S1 or S2 driving the target pixel 122 further includes the interleaving period T2 to ensure that the yellow color displayed by the target pixel 122 is not distorted. In the conventional technique, regarding the driving signal S1 or S2 not including the interleaving period T2, the color displayed by the target pixel 122 driven by the driving signal S1 or S2 is a distorted color, i.e. a dark yellow color.

To be specific, the driving signal S1, for example, first drives the target pixel 122 to display the white color during the reset period T1, and during the interleaving period T2, the voltage level of the driving signal S1 is adjusted to zero. During the display period T3, the driving signal S1 drives the target pixel 122 to display the yellow color. In the present embodiment, the driving signal S1, for example, includes 9 continuous driving waveforms DW to drive the target pixel 122 to display the white color during the reset period T1. The driving signal S1, for example, includes 11 continuous driving waveforms DY to drive the target pixel 122 to display the yellow color during the display period T3. On the other hand, the driving signal S2, for example, first drives the target pixel 122 to display the black color during the reset period T1, and during the interleaving period T2, the voltage level of the driving signal S2 is adjusted to zero. During the display period T3, the driving signal S2 drives the target pixel 122 to display the yellow color. In the present embodiment, the driving signal S2, for example, includes 9 continuous driving waveforms DK to drive the target pixel 122 to display the black color during the reset period T1. The driving signal S2, for example, includes 11 continuous driving waveforms DY to drive the target pixel 122 to display the yellow color during the display period T3. In the present embodiment, the number of the driving waveforms, the voltage level of the driving signal and the time lengths shown in FIG. 2 are only an example, and the invention is not limited thereto.

In the present embodiment, the time length of the interleaving period T2 is, for example, X ms, where X is greater than 0. The time length of X ms, for example, can be adjusted according to a temperature sensed by the electronic paper display 100. The temperature sensed by the electronic paper display 100, for example, includes a whole temperature of a device body of the electronic paper display 100, a temperature of the driver circuit 110 or the electronic paper display panel 120, or an environmental temperature around the electronic paper display 100. For example, when the temperature sensed by the electronic paper display 100 is 5 degrees Celsius, the time of the interleaving period T2 is, for example, 5000 ms, i.e. X=5000. When the temperature of the electronic paper display 100 is 10 degrees Celsius, the time of the interleaving period T2 is, for example, 2000 ms, i.e. X=2000. Namely, the lower the sensed temperature is, the longer the time of the interleaving period T2 is.

In the present embodiment, the temperature sensor 130 senses the temperature of the electronic paper display 100, and transfers a temperature signal S3 to the driver circuit 110. The driver circuit 110 adjusts the time length of the interleaving period T2 according to the temperature signal S3 and a look-up table. The look-up table is, for example, stored in a memory circuit in internal of the driver circuit 110 or stored in a memory circuit inside or outside the electronic paper display 100. The look-up table, for example, includes corresponding relations of temperatures and the time lengths of the interleaving period T2. The content and storing position of the look-up table are not limited by the invention.

In the present embodiment, the various devices in the electronic paper display 100 can be respectively implemented by any proper device structure of related technical field, which is not limited by the invention, and enough instructions and recommendations for the device structures and operation methods can be learned from ordinary knowledge of the technical field.

Figure 3:
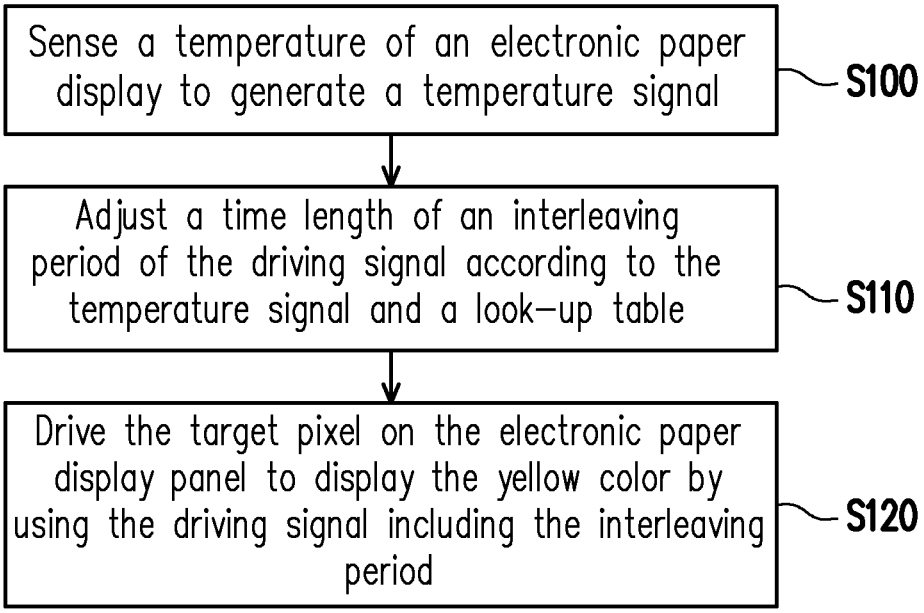
FIG. 3 is a flowchart illustrating a method for driving an electronic paper display panel according to an embodiment of the invention.

FIG. 3 is a flowchart illustrating a method for driving an electronic paper display panel according to an embodiment of the invention. Referring to FIG. 1 and FIG. 3, the method for driving an electronic paper display panel of the present embodiment is at least adapted to the electronic paper display panel 120 of FIG. 1, though the invention is not limited thereto. Taking the electronic paper display panel 120 of FIG. 1 as an example, in step S100, the temperature sensor 130 senses a temperature of the electronic paper display 100, and transfers the temperature signal S3 to the driver circuit 110. In step S110, the driver circuit 110 adjusts the time length X of the interleaving period T2 according to the temperature signal S3 and the look-up table. In step S120, the driver circuit 110 drives the at least one target pixel 122 in a plurality of pixels on the electronic paper display panel 120 to display the yellow color by using the driving signal S1 or S2 including the interleaving period T2. Moreover, enough instructions and recommendations for the method for driving the electronic paper display panel of the present embodiment can be learned from description of the embodiment of FIG. 1 and FIG. 2, so that detail thereof is not repeated.

In summary, in the exemplary embodiment of the invention, between the reset period and the display period, the timing sequence for the driving signal driving the target pixel further includes the interleaving period. The voltage level of the driving signal is zero during the interleaving period, such that the black, white and yellow particles in the electronic paper display panel reach a stable state to ensure that the yellow color displayed by the target pixel is not distorted in subsequent driving.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An electronic paper display, comprising:

an electronic paper display panel, comprising a plurality of pixels;

a driver circuit, coupled to the electronic paper display panel, and driving a target pixel of the pixels to display a color by using a driving signal; and a temperature sensor, coupled to the driver circuit, and configured to sense a temperature of the electronic paper display, and transfer a temperature signal to the driver circuit, wherein the driving signal comprises a reset period, an interleaving period, and a display period, and a voltage level of the driving signal is zero during the interleaving period, wherein the driver circuit adjusts a time length of the interleaving period according to the temperature signal.

2. The electronic paper display as claimed in claim 1, wherein a timing sequence for the driving signal driving the target pixel is sequentially the reset period, the interleaving period and the display period.

3. The electronic paper display as claimed in claim 2, wherein the driver circuit first drives the target pixel to display a black color or a white color during the reset period by using the driving signal, and then drives the target pixel to display the color during the display period.

4. The electronic paper display as claimed in claim 1, wherein the driver circuit further adjusts a time length of the interleaving period according to a look-up table.

5. A method for driving an electronic paper display panel, comprising:

driving a target pixel in a plurality of pixels on the electronic paper display panel to display a color by using a driving signal;

sensing a temperature of the electronic paper display, and transferring a temperature signal to the driver circuit; and adjusting a time length of the interleaving period according to the temperature signal, wherein the driving signal comprises a reset period, an interleaving period, and a display period, and a voltage level of the driving signal is zero during the interleaving period.

6. The method for driving the electronic paper display panel as claimed in claim 5, wherein a timing sequence for the driving signal driving the target pixel is sequentially the reset period, the interleaving period and the display period.

7. The method for driving the electronic paper display panel as claimed in claim 5, wherein the step of driving the target pixel in the pixels on the electronic paper display panel to display the color by using the driving signal comprises:

first driving the target pixel to display a black color or a white color during the reset period by using the driving signal, and driving the target pixel to display the color during the display period by using the driving signal.

8. The method for driving the electronic paper display panel as claimed in claim 5, further comprising:

adjusting a time length of the interleaving period according to a look-up table.

* * * * *